United States Patent [19]

Bhattacharjee et al.

[11] Patent Number: 4,702,807

[45] Date of Patent: Oct. 27, 1987

[54] ELECTROCHEMICAL PROCESS FOR BLEACHING WOOD PULP USING CHLORATE AND A REDOX CATALYST

[75] Inventors: Shyam S. Bhattacharjee, Monroe; Michael N. Hull, Bardonia; Vacheslav M. Yasnovsky, Orangeberry, all of N.Y.

[73] Assignee: International Paper Company, Purchase, N.Y.

[21] Appl. No.: 914,364

[22] Filed: Oct. 2, 1986

[51] Int. Cl.[4] ..... C25F 5/00

[52] U.S. Cl. ..... 204/133; 162/87

[58] Field of Search ..... 204/133; 162/87

[56] References Cited

U.S. PATENT DOCUMENTS

| | | | |
|---|---|---|---|
| 2,307,137 | 1/1943 | Kennedy | 204/133 |
| 2,549,099 | 4/1951 | Kaswell | 204/133 |
| 2,938,826 | 5/1960 | Marpillero | 162/87 |
| 4,039,374 | 8/1977 | Deutsch et al. | 162/87 |

FOREIGN PATENT DOCUMENTS

| | | | |
|---|---|---|---|
| 652899 | 5/1951 | United Kingdom | 204/133 |

*Primary Examiner*—R. L. Andrews

*Attorney, Agent, or Firm*—Walt Thomas Zielinski; Stewart L. Gitler

[57] ABSTRACT

An electrochemical process for delignification and bleaching of pulp fibers is disclosed. The process involves the use of metallic chlorates and vanadium catalysts in the presence of an electric current to provide a pulp fiber of improved brightness and viscosity.

16 Claims, 4 Drawing Figures

MECHANISM OF COLOR REDUCTION BY VANADIUM

U.S. PATENT NO. 4,039,374 (PRIOR ART)

$V^{5+}$ + COLOR BODIES → OXIDIZED COLOR BODIES + $V^{4+}$ $6V^{4+} + ClO_3^- \; 6H^+ \longrightarrow 6V^{5+} + Cl^- + 3H_2O$

VANADIUM ($V^{4+}$) → CATALYZED BLEACHING

ELECTROCHEMICAL PROCESS FOR BLEACHING WOOD PULP USING CHLORATE AND A REDOX CATALYST

BACKGROUND OF THE INVENTION

Field of the Invention

This invention relates to methods for the delignification and bleaching of cellulosic pulp using metallic chlorates in the presence of a vanadium catalyst.

BRIEF DESCRIPTION OF THE PRIOR ART

The delignification and bleaching of wood pulp employing chlorine dioxide prepared from sodium chlorate is a well-known procedure. The direct use of sodium chlorate for pulp bleaching without first converting it to chlorine dioxide has also been described in the existing art; see for example U.S. Pat. No. 2,938,826 which discloses chlorate bleaching in the presence of a catalyst that comprises vanadium and tin. The use of sodium chlorate in the presence of vanadium pentoxide has been described in Rapson et al., TAPPI, Volume 42, No. 8, August 1959, page 642.

U.S. Pat. No. 4,039,374 discloses the bleaching of pulp fibers with chlorine dioxide in the presence of vanadium in the +4 or +5 oxidation state. The vanadium ($V^{5+}$) oxidizes lignin chromophores and itself reduces to ($V^{4+}$) which reacts with chlorate to yield chloride ions; see for example U.S. Pat. No. 4,039,374, and TAPPI 62, Volume 62, No. 12, 1979, page 53. (See FIG. 1)

The direct use of sodium chlorate for pulp bleaching, without first converting it to chlorine dioxide eliminates the need for a chlorine dioxide generator and allows the chlorate that is found (30% of $ClO_2$ applied) during chlorine dioxide bleaching to be reused.

It is the object of the present invention to provide a bleaching process where chlorates are used directly for pulp bleaching in the presence of a catalyst which is being generated electrochemically.

SUMMARY OF THE INVENTION

The invention relates to a process for the delignification and bleaching of wood pulp fiber comprising the use of alkali metal chlorates, a redox catalyst (vanadium), and electric current (e−) and vanadium in the $V^{4+}$ form being constantly generated electrochemically.

Vanadium in the $V^{4+}$ form reacts with chlorate to yield chlorine dioxide and other oxidizing species while itself being oxidized to $V^{5+}$; $V^{5+}$ is then electrochemically reduced to $V^{4+}$. The wood pulp is bleached using a metal chlorate directly, and the chlorate formed in the bleaching reaction is fully utilized for bleaching by recycling the filtrate. Because of the efficient pulp washing, the overall requirement for sodium chlorate is reduced as compared to conventional chlorine bleaching. (see FIG. 2)

DETAILED DESCRIPTION OF THE INVENTION

Figures 1, 2:
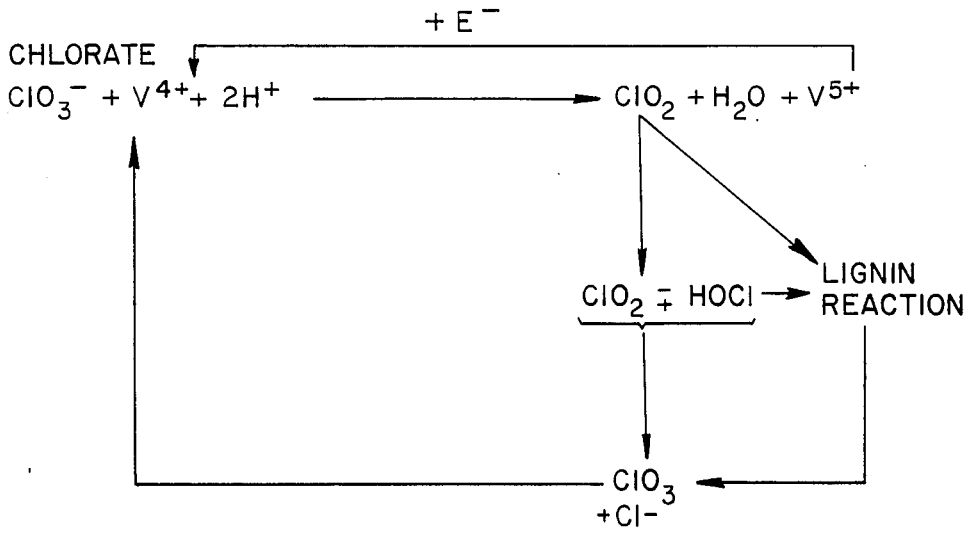
FIG. 1 is a schematic of the process depicting the prior art.
FIG. 2 is a schematic diagram of the preferred process of the invention.
Figure 3:
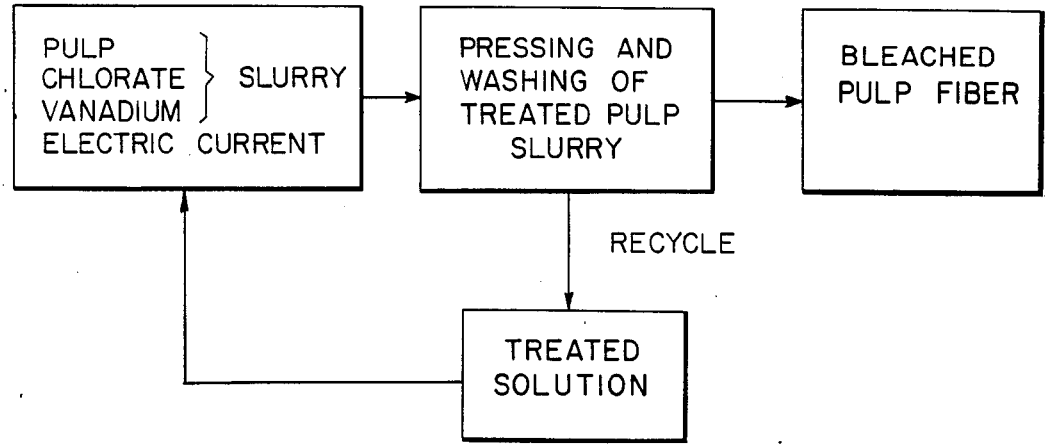
FIG. 3 is a block diagram of the preferred process of the invention.

The process of the invention is carried out by adding wood pulp to a solution comprising sodium chlorate and sodium vanadate at an appropriate acid pH (adjusted with mineral acid) and stirring the pulp slurry while electric current is passed through the electrodes immersed in the slurry (FIG. 3).

The pH of the solution can range from 1.0 to about 6.0. Such pH is adjusted through the addition of mineral acid. The temperature of the solution is maintained in the range of about 40° C. to about 85° C. Such a process is carried out from 1.0 to about 5.0 hours with a wood pulp consistency of about 0.5%–10%.

The concentration of the chlorate ranges from 0.001M to 7M, preferably from 0.1M to about 1.0M. Sodium chloride or sodium sulfate are possible replacements for a portion of the sodium chlorate to serve as an electrolyte. Other vanadium salts may also be applied.

Electric current ranging from about 1,350 coulombs/lb pulp to about 13,500 coulombs/lb pulp is passed through the electrodes immersed in the slurry during the entire bleaching period. In addition, electric current may be passed through the solution of sodium chlorate and sodium vanadate for 10 to 60 minutes prior to the addition of pulp to the bleaching solution.

Figure 4:
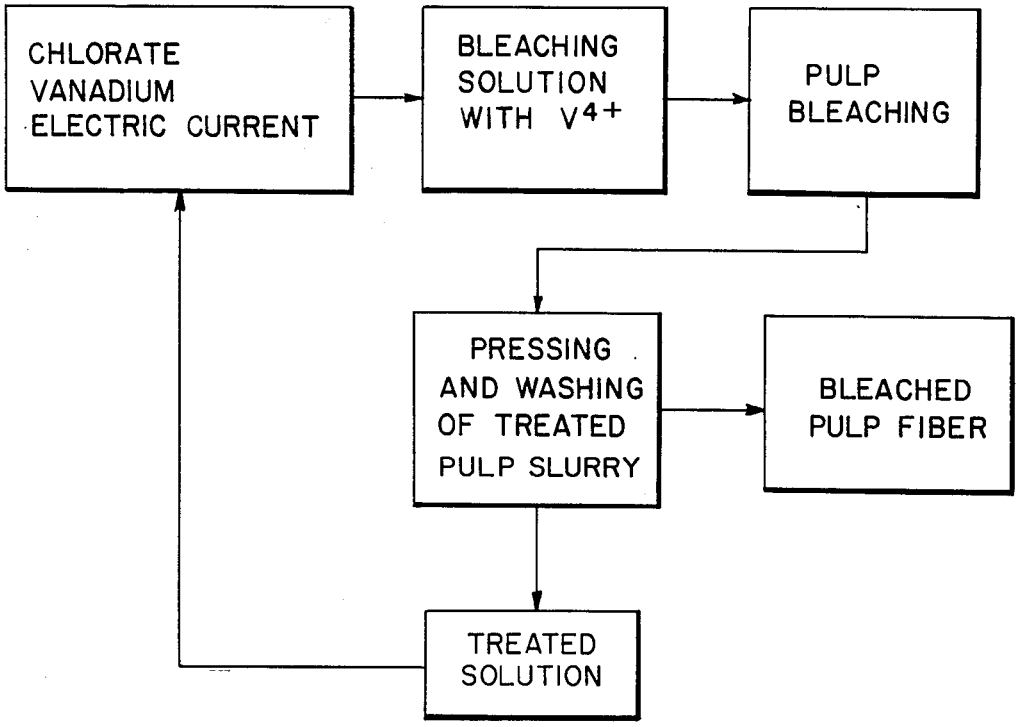
FIG. 4 is a block diagram of an alternate embodiment of the invention.

In one alternate embodiment, the process of the invention is carried out by passing electric current through a solution containing a metal chlorate and a vanadium compound, to generate $V^{4+}$ chlorine dioxide; and other chlorine species; and then using the resulting solution to bleach pulp fibers (FIG. 4).

The following examples describe the process of making and using the invention and set forth the best mode contemplated by the inventors of carrying out the invention, but are not to be construed as limiting.

Examples 1–6 of the process were all performed in a stainless steel beaker with a Teflon TM cover through which reference electrodes and positive platinum electrodes were passed into the pulp slurry. The stainless steel beaker served as a negative electrode. In Example 7, the bleaching solution containing $V^{4+}$ was prepared beforehand, and no electric current was passed through the wood pulp slurry.

In general, the pulp slurry, comprising 10 grams of pulp in one liter of a solution containing chlorate and vanadium catalyst, was stirred magnetically during the bleaching period, and then filtered and washed. The bleached pulps were tested for brightness using a GE brightness tester and viscosity:

EXAMPLE 1

A softwood kraft pulp (Kappa No. 35), after chlorination and alkaline extraction was washed to obtain a $C_DE$ pulp having a permanganate number of 3.0 and a brightness of 43% GE. A slurry of 10 g of the above-identified pulp in one liter of a solution containing 1.0 g of sodium chlorate, 0.58 g of sodium chloride and 0.012 g of sodium vanadate at pH 2.2 was stirred for three hours at 60° C. In four other runs, increasing amounts of electricity were passed through the pulp slurries. The amount of electricity imparted in each run and the resultant brightness of the pulps obtained and their viscosities are shown in Table 1 below.

TABLE 1

| RUN | ELECTRIC CURRENT (COULOMB'S) | PULP PROPERTIES BRIGHTNESS (% GE) | VISCOSITY (cP) |
|---|---|---|---|
| 1 | 0 | 65.9 | 23.0 |
| 2 | 162 | 73.5 | 19.0 |
| 3 | 270 | 74.3 | 19.0 |
| 4 | 540 | 75.3 | 16.5 |
| 5 | 810 | 74.0 | 16.6 |

The above table illustrates that the brightness level of the pulp improved considerably due to the addition of electric current. Some loss in viscosity takes place as the amount of current is increased.

EXAMPLE 2

A hardwood kraft pulp (Kappa No. 16), after chlorination and alkaline extraction was washed to obtain a $C_DE$ pulp in one liter solution, at pH 1.7 and a temperature of 60° C., the solution containing 100 g of sodium chlorate and 0.24 g of sodium vanadate. Run 1 was performed with no electric current and a bleaching time of 2 hours; Run 2 was performed with no electric current and a bleaching time of 3 hours; Run 3 was performed with electric current and a bleaching time of 2 hours; Run 4 was performed with electric current and a bleaching time of 2 hours as in Run 3, but in addition current was passed through the solution for about 30 minutes prior to the addition of pulp to the solution.

Table 2 illustrates the relation between the electric current and bleaching time impartial to the pulp and the resultant % GE brightness and viscosity.

TABLE 2

| RUN | ELECTRIC CURRENT (COULOMB'S) | BLEACHING TIME (hr) | PULP PROPERTIES BRIGHTNESS (% GE) | VISCOSITY (cP) |
|---|---|---|---|---|
| 1 | 0 | 2.0 | 75.3 | 40.5 |
| 2 | 0 | 3.0 | 78.9 | 37.3 |
| 3 | 179 | 2.0 | 78.5 | 42.3 |
| 4* | 179 | 2.0 | 78.2 | 45.2 |

*An additional electric current (50 coulombs) was passed through the chlorate/-vanadium solution prior to addition of the pulp.

The above table shows that the brightness level is considerably improved when electric current is used. At the same brightness level, the process utilizing the electric current gives higher viscosity than that obtained without current. As can be seen from Run 4, even further improvement occurs in the viscosity of the pulp if electric current is passed through the chlorate/-vanadium solution to convert all $V^{5+}$ to $V^{4+}$ prior to addition of the pulp. This clearly illustrates the superiority of $V^{4+}$ catalyst as compared to the $V^{5+}$ catalyst.

EXAMPLE 3

A hardwood kraft pulp after chlorination and alkaline extraction was washed to obtain a $C_DE$ pulp having a permanganate number of 2.5. The pulp was treated with sodium chlorate directly at varying pH in the presence of $V^{4+}$ catalyst. The $V^{4+}$ form was constantly being produced electrochemically by reducing $V^{5+}$ to $V^{4+}$. The results of these runs, as illustrated in Table 3, show that the pulp properties, that is Brightness and Viscosity, approach those of pulp bleached conventionally with chlorine dioxide; pulp viscosity is better at low pH (approximately 2.0); and viscosity loss can be additionally minimized by using a viscosity preserver, such as diethylamine or the like.

TABLE 3

VANADIUM-CATALYZED CHLORATE BLEACHING OF HARDWOOD KRAFT $C_DE$ PULP*

| RUN | | % GE BRIGHTNESS | VISCOSITY (cP) |
|---|---|---|---|
| 1 | Standard Dioxide Bleach (1% $ClO_2$) | 85.1 | 20.0 |
| 2 | Electrochemical (pH 4, 60° C.) | 82.8 | 9.5 |
| 3 | Electrochemical (pH 3, 70° C.) | 85.0 | 11.9 |
| 4 | Electrochemical (pH 2, 60° C.) | 82.5 | 17.3 |
| 5 | Electrochemical (pH 2, 60° C.) with viscosity preserver** | 83.8 | 19.7 |

*Electrochemical bleaching conditions: pulp consistency (1%); sodium chlorate (1 M); vanadium (1 mmol); T = 3 hr; electric current = 172 coulombs
**Selected from the group diethylamine, dimethylamine and sulfamic acid

EXAMPLE 4

A softwood kraft pulp after being semi-bleached through $C_DEDE$ was washed to obtain a pulp having 64% GE brightness and a viscosity of 24 cP. The $C_DEDE$ pulp (10 g) and sulfamic acid (2 g) were added to a solution (1 liter) comprising sodium chlorate (100 g) and sodium vanadate (0.6 g) at pH 1.8 and T=60° C., and stirred for 2 hours while current (50 mAmp) was passed. In addition, current (25 mAmp) was passed through the solution containing chlorate and vanadium for 30 minutes prior to the addition of the pulp. Table 4 shows the pulp properties of the run as compared with the pulp properties obtained by standard chlorine dioxide bleaching.

TABLE 4

| PROCESS | PULP PROPERTIES % GE BRIGHTNESS | VISCOSITY (cP) |
|---|---|---|
| 1. Chlorate/vanadium/ electric current bleaching | 85 | 23 |
| 2. Standard $ClO_2$ Bleaching | 85 | 24 |

As can be seen from the results in Table 4, the pulp properties are comparable.

EXAMPLE 5

A softwood kraft pulp (Kappa No. 35) after chlorination and extraction was washed to obtain a pulp having permanganate number of 3.5. Three equal portions of this pulp were treated with chlorine dioxide (1.2% on pulp) using vanadyl sulfate ($V^{4+}$) and sodium vanadate ($V^{5+}$) respectively as additives. No current was passed through the pulp slurry during these runs.

The results in Table 5 show that both the $V^{4+}$ and $V^{5+}$ forms increase pulp brightness with a slight reduction of viscosity, when they are added in the dioxide bleaching stage. However, it was observed that the chlorate concentration in the effluent is reduced only in the case of the $V^{4+}$ addition. This supports the conclusion that $V^{4+}$, rather than $V^{5+}$, is the active species in generating the oxidizing species in situ ($ClO_2$ and possibly others) from chlorate, and this mechanism clearly differs from the mechanism suggested by the Deutsch et al article, "Vanadium Pentoxide Catalysis of Chlorine Dioxide Bleaching", TAPPI 62 (12):53, 1979.

TABLE 5

EFFECT OF VANADIUM ADDITIONS IN $D_1$ STAGE OF SOFTWOOD KRAFT PULP BLEACHING

| ADDITIVE | END pH | BRIGHTNESS % GE | CHLORATE INFILTRATE, % MOLE OF ADDED $ClO_2$ |
|---|---|---|---|
| 1. Control $ClO_2$ bleaching (w/o additive) | 4.1 | 78.1 | 33 |
| 2. $V^{4+}$, 0.5% | 3.9 | 80.4 | 19 |
| 3. $V^{5+}$, 0.5% | 3.0 | 80.4 | 27 |

EXAMPLE 6

A softwood kraft pulp (Kappa No. 35) was treated with sodium chlorate, sodium vanadate at varying pH while electric current was passed through the slurry. The results in Table 6 show that delignification of kraft pulp is effective under these conditions.

TABLE 6

CHLORATE/VANADIUM ($V^{4+}$) DELIGNIFICATION OF 35 KAPPA SOFTWOOD KRAFT PULP

| | pH | PULP PROPERTIES* KAPPA NO. | VISCOSITY, cP |
|---|---|---|---|
| 1. | 4 | 16.0 | 20.9 |
| 2. | 3 | 9.6 | 20.9 |
| 3. | 2 | 6.3 | 22.2 |

*Kappa No. and viscosity determinations were made after an alkaline extraction following the chlorate/vanadium treatment.

EXAMPLE 7

A semibleached ($C_D$EDE) softwood kraft pulp (10 g) having 64% GE brightness and 0.5 CED viscosity of 25 cP's was stirred in a solution containing sodium chlorate (60 mg) and vanadyl sulfate (60 mg) for 3 hours at 60° C. In a similar run, the vanadyl sulfate was replaced by 12 mg of sodium vanadate and electrical current. The results as displayed in Table 7 show that properties of pulps obtained from both experiments are comparable.

The bleaching process can be operated in either of the methods as illustrated in FIGS. 3 and 4.

TABLE 7

| | SODIUM CHLORATE AND VANADYL SULFATE ($V^{4+}$) WITHOUT ELECTRIC CURRENT | SODIUM CHLORATE AND SODIUM VANADATE AND ELECTRIC CURRENT TO GENERATE $V^{4+}$ CONTINUOUSLY |
|---|---|---|
| Brightness, % Ge | 80.1 | 80.0 |
| Viscosity, cP | 20.8 | 21.4 |

Inasmuch as the invention is subject to various change and variations, the foregoing should be regarded as merely illustrative of the invention defined by the following claims.

What is claimed is:

1. An electrochemical process for the delignification and bleaching of cellulosic pulp fibers which comprises the steps of:

(a) mixing said pulp fibers with a solution comprising a metal chlorate and a vanadium compound as a catalyst to form an untreated slurry;

(b) passing an electric current through said pulp slurry maintained at a pH less than 4.0 to form a treated slurry;

(c) pressing and washing said treated slurry to remove said pulp fibers from said treated solution.

2. The process as recited in claim 1 further comprising the step of recycling said leftover treated solution back to said untreated slurry.

3. The process as recited in claim 1 further comprising the step of passing an additional electric current through said untreated solution containing a metal chlorate and a vanadium compound prior to addition of said pulp fibers.

4. The process as recited in claim 2 further comprising the step of passing an additional electric current through said untreated solution containing a metal chlorate and a vanadium compound prior to addition of said pulp fibers.

5. The process as recited in claim 1 wherein said electric current ranges from about 1,350 coulombs/lb pulp to about 13,500 coulombs/lb pulp.

6. The process as recited in claim 1 wherein the pH of the pulp slurry is within the range from about 1.5 to about 2.5.

7. The process as recited in claim 2 wherein the pH of the pulp slurry is within the range from about 1.5 to about 2.5.

8. The process as recited in claim 1 wherein the concentration of said metal chlorate is within the range from about 0.001M/L to 7M/L.

9. The process as recited in claim 2 wherein the concentration of said metal chlorate is within the range from about 0.001M/L to 7M/L.

10. The process as recited in claim 1 wherein the concentration of said vanadium compound is within the range from about 0.01 mM/L to about 50 mM/L.

11. The process as recited in claim 2 wherein the concentration of said vanadium compound is within the range from about 0.01 mM/L to 50 mM/L.

12. The process as recited in claim 1 further comprises the step of adding a viscosity preserver selected from the group comprising dimethylamine, diethylamine, and sulfamic acid.

13. An electrochemical process for the delignification and bleaching of cellulosic pulp fibers which comprises the steps of:

(a) mixing said pulp fibers with a solution comprising a metal chlorate wherein the concentration of said metal chlorate is within the range from about 0.1M/L to 1M/L and a vanadium compound wherein the concentration of said vanadium compound is within the range from about 0.1 mM/L to about 5.0 mM/L, as a catalyst to form an untreated slurry;

(b) passing an electric current ranging from about 1,350 coulombs/lb pulp to about 13,500 coulombs/lb pulp through said pulp slurry maintained at a pH ranging from about 1.5 to about 2.5; and (c) pressing and washing said treated slurry to remove said pulp fibers from said treated solution.

14. The process as recited in claim 13 further comprising the step of recycling said leftover treated solution back to said untreated slurry.

15. An electrochemical process for the delignification and bleaching of cellulosic pulp fibers comprising the steps of:

(a) passing an electric current through a solution containing a metal chlorate and a vanadium compound whereby $V^{4+}$, chlorine dioxide and other reduced chlorine species are generated to form a treated solution;

(b) mixing said treated solution with said pulp fibers to form a treated slurry; and (c) pressing and washing said treated slurry to remove said pulp fibers from said treated solution.

16. The process as recited in claim 15 further comprising the step of recycling said leftover treated solution back to said untreated slurry.

* * * * *